US007886786B1

(12) United States Patent
Christie

(10) Patent No.: US 7,886,786 B1
(45) Date of Patent: Feb. 15, 2011

(54) HANDBAG WITH CONVENIENCE FEATURES

(76) Inventor: Thai Christie, 10929 Park Rd., Fairfax, VA (US) 22030

( * ) Notice: Subject to any disclaimer, the term of this patent is extended or adjusted under 35 U.S.C. 154(b) by 17 days.

(21) Appl. No.: 12/156,646

(22) Filed: Jun. 4, 2008

(51) Int. Cl.
*A45C 13/22* (2006.01)
*A45C 13/26* (2006.01)
*A45C 13/30* (2006.01)
*A45C 13/02* (2006.01)

(52) U.S. Cl. ..... 150/108; 150/105; 150/112; 150/114; 190/1; 190/39; 224/610; 383/14; 383/16

(58) Field of Classification Search ..... 150/105, 150/107, 108, 112, 114; 190/39, 902, 1, 190/111; 224/458, 610, 614; 383/4, 14, 383/16
See application file for complete search history.

(56) References Cited

U.S. PATENT DOCUMENTS 2,080,453 A 5/1937 Kraut
2,487,220 A * 11/1949 Callaghan ..... 206/541
2,723,696 A * 11/1955 Kase ..... 150/105
2,725,088 A * 11/1955 Kaplan ..... 150/110
3,117,607 A * 1/1964 Siegel ..... 150/117
4,177,909 A * 12/1979 Haskell ..... 224/153
4,739,809 A * 4/1988 Adams ..... 150/112
5,431,317 A * 7/1995 Kliot ..... 224/153
5,476,163 A * 12/1995 Wu ..... 190/115
5,503,204 A 4/1996 Byers et al.
5,676,223 A 10/1997 Cunningham
5,713,439 A * 2/1998 Zionts et al. ..... 190/102
5,725,039 A * 3/1998 Macinai et al. ..... 150/104
5,743,447 A 4/1998 McDermott
5,749,447 A 5/1998 Hersh et al.
5,873,730 A * 2/1999 Strong ..... 434/219
5,911,262 A * 6/1999 Steinhart ..... 150/103
5,927,581 A * 7/1999 Reddy et al. ..... 224/578
6,305,587 B1 * 10/2001 Miller ..... 224/153
6,491,074 B1 * 12/2002 Roegner ..... 150/112
6,666,363 B2 * 12/2003 Godshaw et al. ..... 224/578
7,246,643 B2 * 7/2007 Andrews ..... 150/105
2005/0193476 A1 * 9/2005 Chinn ..... 2/247
2006/0042732 A1 * 3/2006 Oh ..... 150/107

* cited by examiner

*Primary Examiner*—Sue A Weaver

(57) ABSTRACT

A carrying container in a form of an ergonomically shaped handbag that has a variety of convenience features. The convenience features include, but are not limited to, a self locking top flap, a secure ID feature implemented in the top flap, a hidden retractable handle, hidden secret compartments, compartment quick access features and detachable shoulder strap, a plurality of interchangeable top flaps and a back flap. A handbag has an ergonomic shape that provides for added convenience of carrying the handbag under the arm. The handbag also has a detachable strap that can be used for carrying the bag in a variety of ways.

16 Claims, 16 Drawing Sheets

HANDBAG WITH CONVENIENCE FEATURES

BACKGROUND OF THE INVENTION

1. Field of the Invention

The present invention relates to the ergonomic handbag having a variety of convenience features.

2. Description of the Related Art

Handbags, pocketbooks, briefcases and other carrying containers having various compartments are well known. Conventional handbags typically have a rectangular shape and are commonly constructed with a number of interior compartments for retaining items such as cell phones, cosmetics, wallets and other personal things for an easy access by a user. Typically the access to these interior compartments is provided through the main entry way to the container.

In case of a conventional handbag, the main entry way is located at the top of the handbag and all of the interior compartments can only be accessed via the opening at the top of the handbag. This convention arrangement is inconvenient as smaller items such as keys, wallets with ID cards, cell phones, loose change and etc. tend to end up at the bottom of the handbag and cannot be easily accessed when needed.

This arrangement is also not safe when traveling as a pickpocket can reach into the handbag through the main opening and get a quick access to valuables located in the compartments of the handbag. It is desirable to have a travel handbag that has some hidden compartments that cannot be accessed through the opening at the top of a handbag, where things like identification documents and wallets can be securely stored.

In particular, the need for accessing person's ID cards has become an integral part of every day life and it is particularly crucial when traveling. However, each time the ID card is taken out of the wallet there is a risk of it being misplaces, lost or even stolen. Taking the wallet out of a handbag every time the ID card is requested also presents some risks of it being lost or stolen. A person can be busy looking after his or her luggage, attending to children, handling event or airline tickets, talking on a cell phone and doing other things while searching through a handbag for an ID. Conventional handbags do not provide any special means for secure handling of ID cards. Therefore, there is a need for a handbag with a special feature for storing and easily presenting the ID cards or other documents upon request.

Conventional handbags have an overlapping top flap that has a lock or a buckle that needs to be closed after the bag was open. It is also inconvenient as a person has to remember to close the bag each time after opening it. Therefore, it is desirable to have a handbag that closes as soon as the top flap is flapped back in place without a user having to click a buckle or turn a lock.

Furthermore, conventional handbags have a square or rectangular shape that makes it not very convenient for carrying them under an arm. A handbag with a convenient ergonomic shape is desired. Typically handbags have a shoulder strap or a handle or both. So they offer only one or two ways of carrying them. However, a user may want to be able to carry a handbag as a backpack when it is loaded with more stuff or carry it is a brief case when entering the office. Therefore, a handbag having convenience features that allow for various ways of carrying it is also desired.

The conventional handbags can have only one color and exterior design which cannot be changed on the fly. Yet a person may want to have a handbag that can change its color and appearance or to personalize the design of his or her bag to match the outfit the person decides to wear. Having a large number of handbags matching each of the person's outfits can be very costly and simply impossible. Therefore, a handbag that has convenience features allowing for color and exterior changes is highly desirable.

Accordingly, there is a need in the art for a handbag with convenience features that overcomes all of the above mentioned shortcomings of the conventional handbags.

SUMMARY OF THE INVENTION

Accordingly, the present invention is related to a multipurpose carrying container that substantially obviates one or more of the disadvantages of the related art.

In exemplary embodiment, there is provided a carrying container in a form of an ergonomically shaped handbag that has a variety of convenience features. These features include, but are not limited to, a self locking replaceable top flap, a secure ID feature implemented in the top flap, a hidden retractable handle, hidden secret compartments, compartment quick access features, detachable shoulder strap etc. The handbag's quick access feature for a cell phone, ipod or another such a device is described in the commonly owned U.S. Pat. No. 7,252,183 B.

According to an exemplary embodiment, the handbag has an ergonomic shape that provides for added convenience of carrying the handbag under the arm. The curve (i.e., half elliptical) shape of the side walls of the bag allows for an easy access and retrieval of objects from its outer pockets. It also provides a proper positioning and self locking of the handbag's top flap. The detachable replaceable top flap of the exemplary embodiment conveniently covers the entire bag except for the side walls. Therefore, by changing the top flap, a user can essentially change color, style and overall appearance of the handbag. Thus a person, when buying a handbag, can essentially get a several colors and exterior designs to choose from. Those skilled in the art would appreciate that the handbag of the preferred embodiment is absolutely multipurpose and can be used for any occasion and with any type of an outfit.

A special secure ID feature implemented in the top flap of a handbag provides for secure hidden storage of person's ID cards and other important cards, such as, for example, membership cards or credit cards. The cards can be easily displayed upon request without being taken out of a special compartment, which really adds a lot of convenience to the users, who do not have to look for a wallet or a card itself inside the bag each time they need to present it.

The handbag, according to the exemplary embodiment, has retractable handle that is completely hidden and can be easily retracted when needed. This feature provides a user with another convenient way of carrying the handbag as if it were a briefcase. The shoulder strap can be removed and stored inside the handbag. The handbag is also equipped with some hidden compartments that cannot be accessed through the opening at the top of the handbag. The secret hidden compartment is located behind the special compartment for the retractable handle. Therefore, the handle also serves as a locking mechanism to the secret hidden compartment.

Additional features and advantages of the invention will be set forth in the description that follows, and in part will be apparent from the description, or may be learned by practice of the invention. The advantages of the invention will be realized and attained by the structure particularly pointed out in the written description and claims hereof as well as the appended drawings.

It is to be understood that both the foregoing general description and the following detailed description are exemplary and explanatory and are intended to provide further explanation of the invention as claimed.

BRIEF DESCRIPTION OF THE ATTACHED FIGURES

The accompanying drawings, which are included to provide a further understanding of the invention and are incorporated in and constitute a part of this specification, illustrate embodiments of the invention and together with the description serve to explain the principles of the invention.

DETAILED DESCRIPTION OF THE PREFERRED EMBODIMENTS

Reference will now be made in detail to the embodiments of the present invention, examples of which are illustrated in the accompanying drawings.

The present invention is related to a multipurpose carrying container in a form of a handbag with a plurality of convenience features. According to a preferred embodiment, an ergonomically shaped handbag that has a variety of convenience features is provided. These features include, but are not limited to, a self locking detachable replaceable top flap, a secure ID feature implemented in the top flap, a hidden retractable handle, secret specialized compartments, compartment quick access features, detachable shoulder strap, back flap etc.

Figure 1:
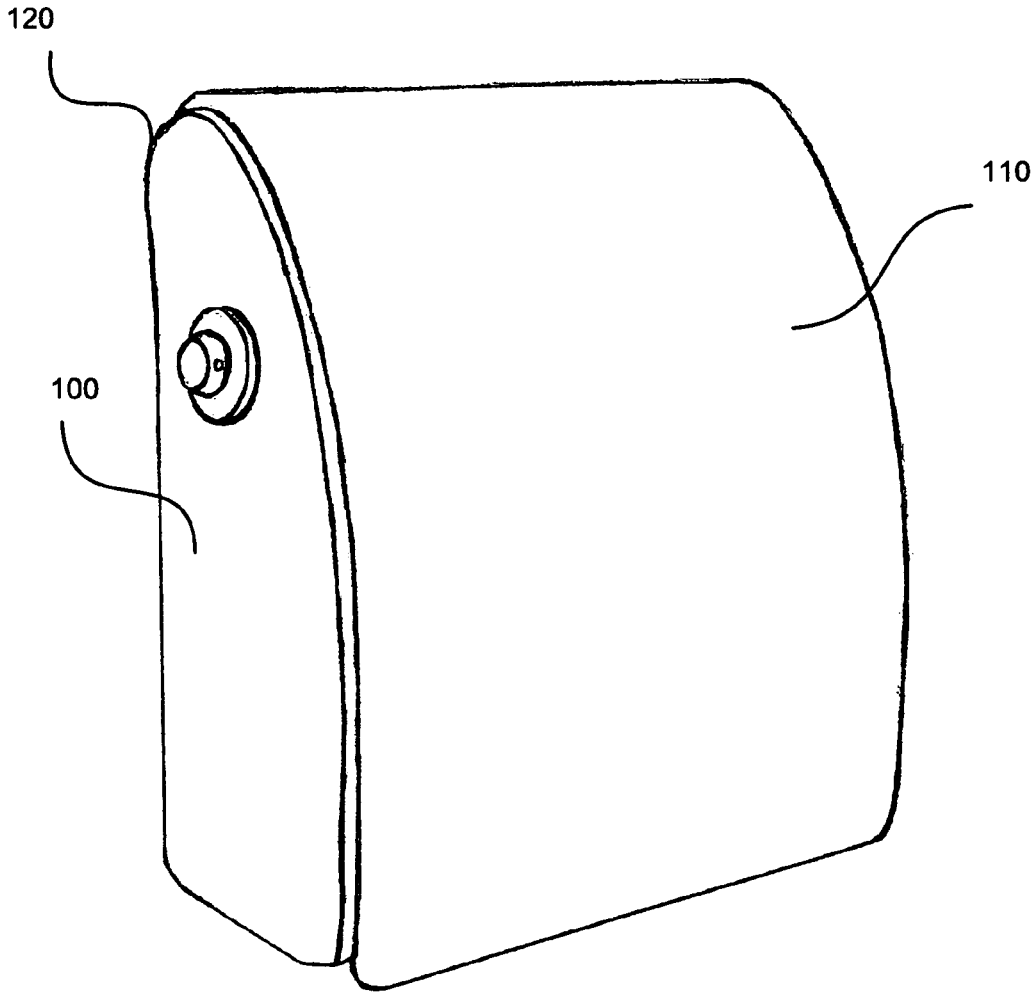
FIG. 1 shows a front view of a handbag, in accordance with the exemplary embodiment.
Figure 2:
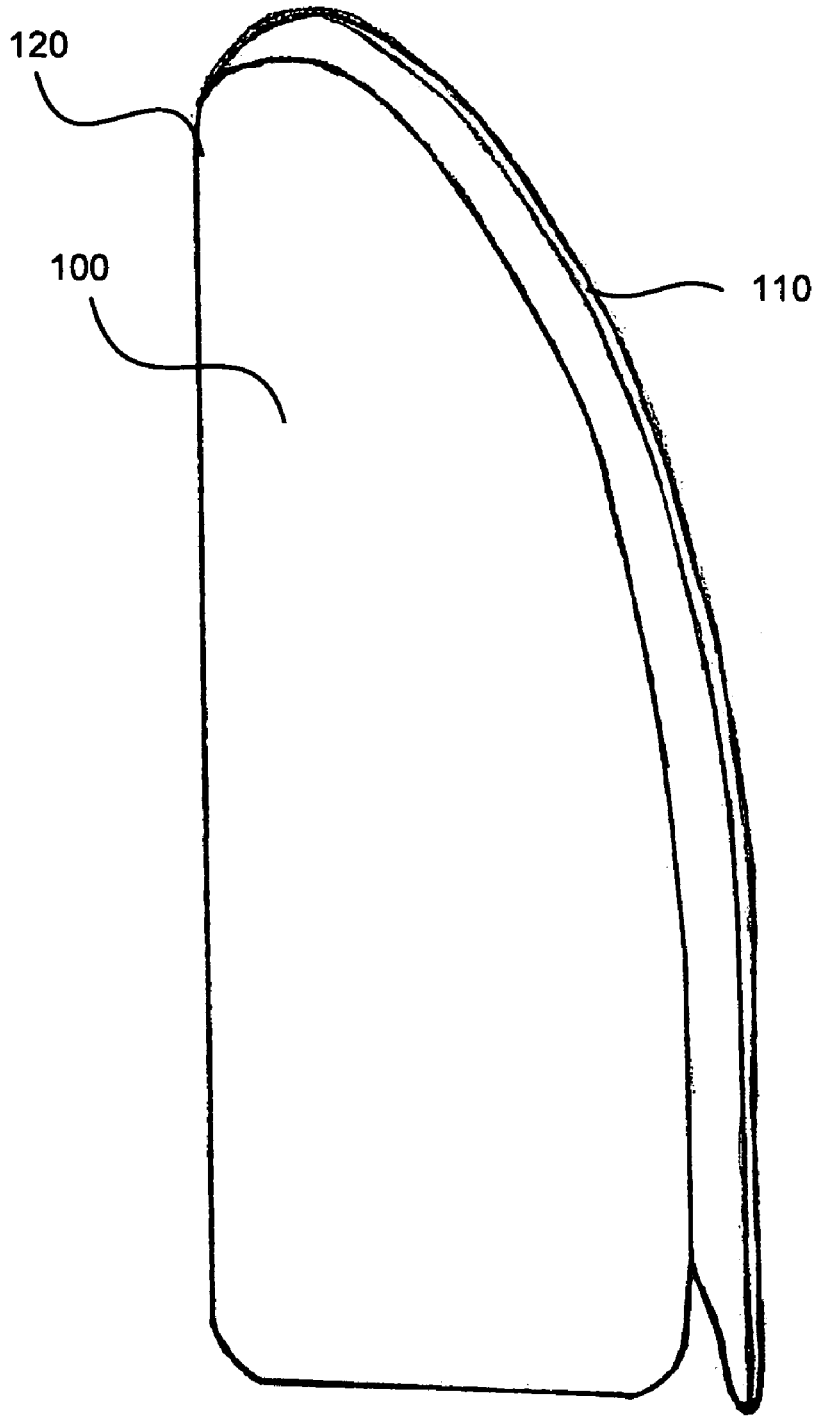
FIG. 2 shows a side view of a handbag, in accordance with the exemplary embodiment.

According to an exemplary embodiment, the handbag has an ergonomic shape that provides for added convenience of carrying the handbag under the arm. The front view of a handbag is shown in FIG. 1 depicting half-elliptical sidewalls 100 and a top flap 110. The side view of a handbag is shown in FIG. 2 also depicting ergonomically shaped half-elliptical sidewalls 100 and a top flap 110. The ergonomically shaped side walls 100 allow the top flap 110 to cling to the bag practically under its own weigh. Alternatively, the flap can be equipped with a magnet or a Velcro™ type pad. In either way the top flap advantageously does not require any special actions from a user in order to close a handbag. Thus, ergonomically shaped sidewalls 100 not only provide for increased convenience of carrying the handbag, but also provide for a self-locking feature of the top flop 110 of a handbag.

Figure 3:
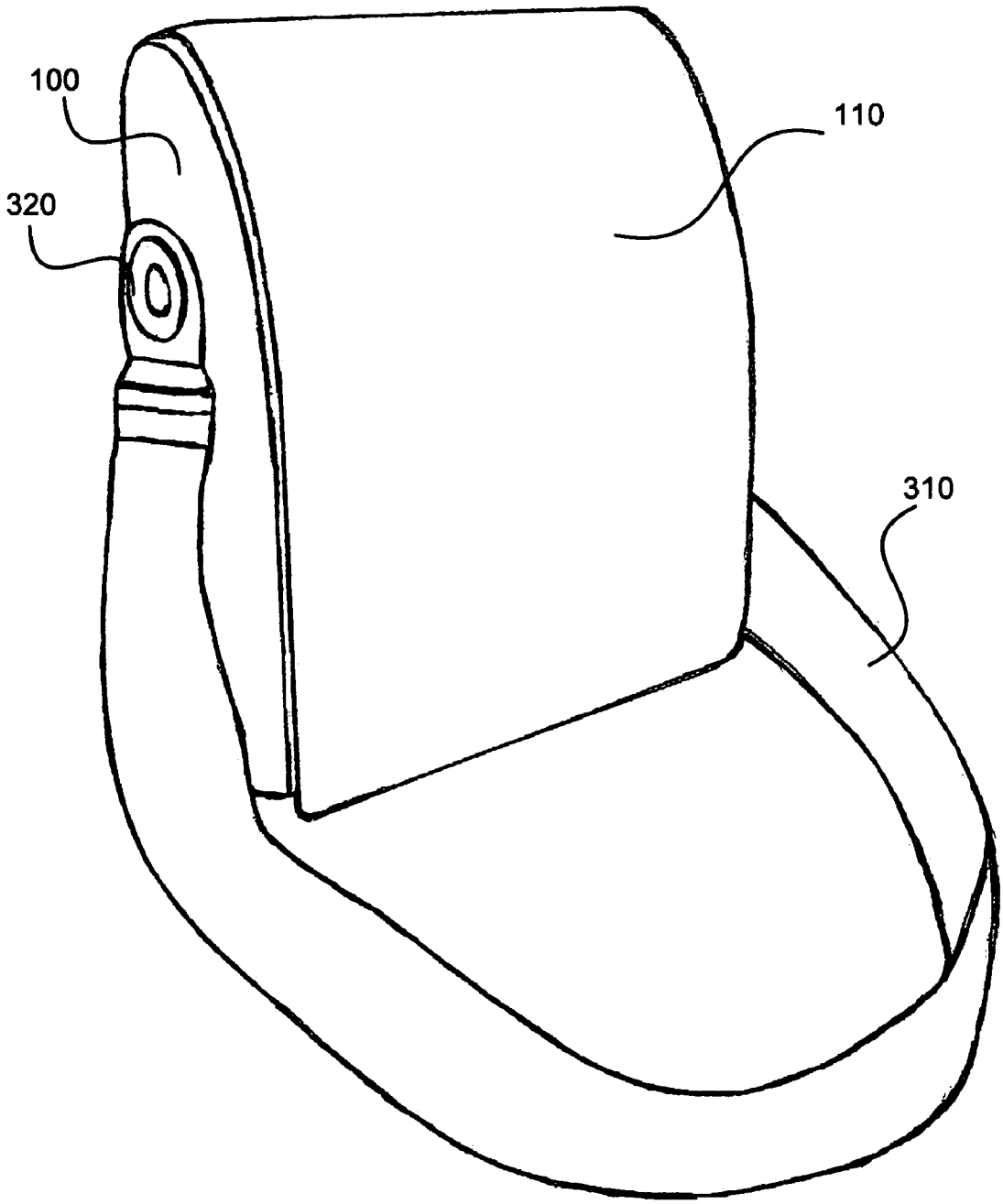
FIG. 3 shows a handbag, in accordance with the exemplary embodiment, with a shoulder strap attached.
Figure 4:
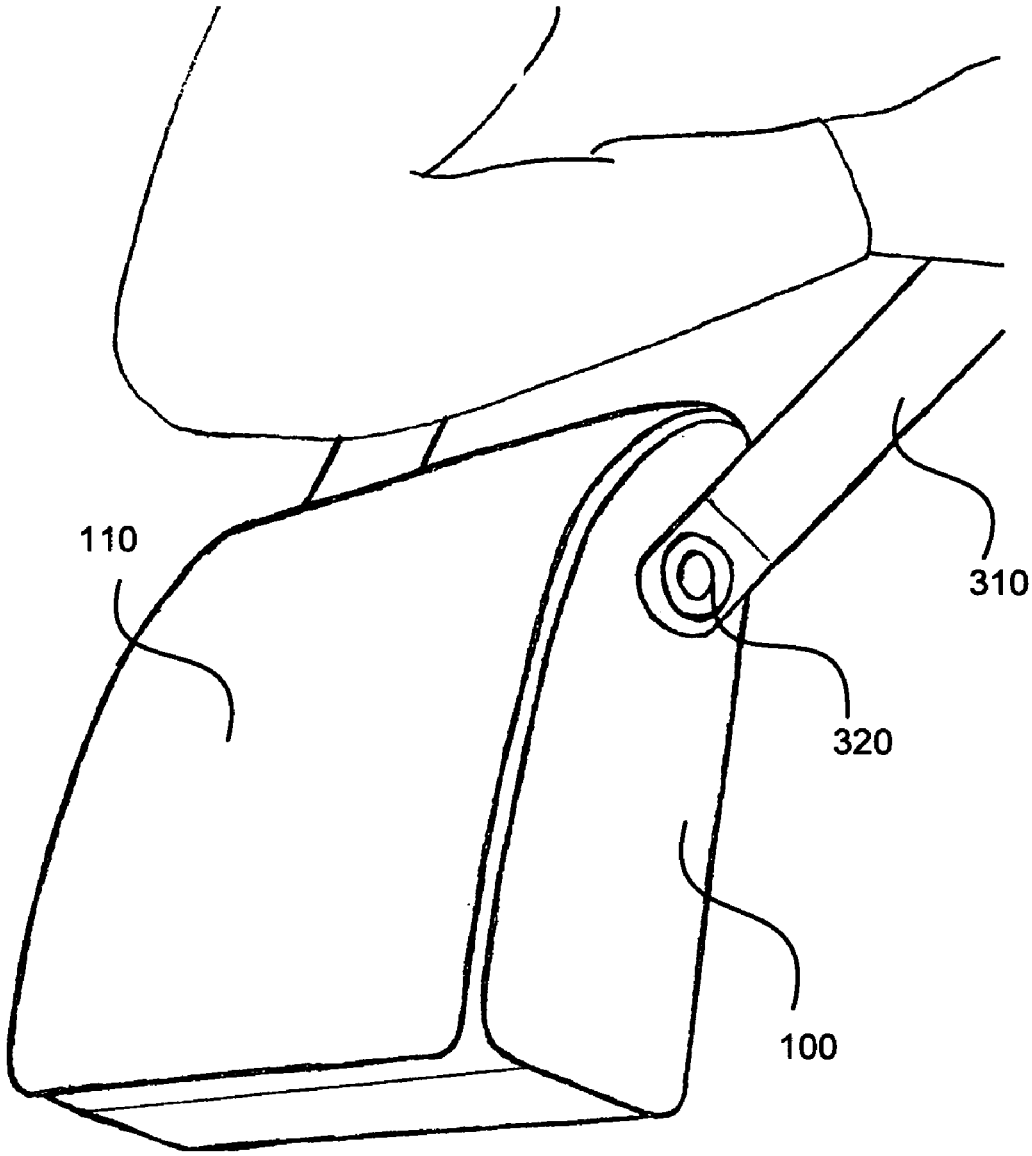
FIG. 4 illustrates how a handbag can be carried, in accordance with the exemplary embodiment.
Figure 5:
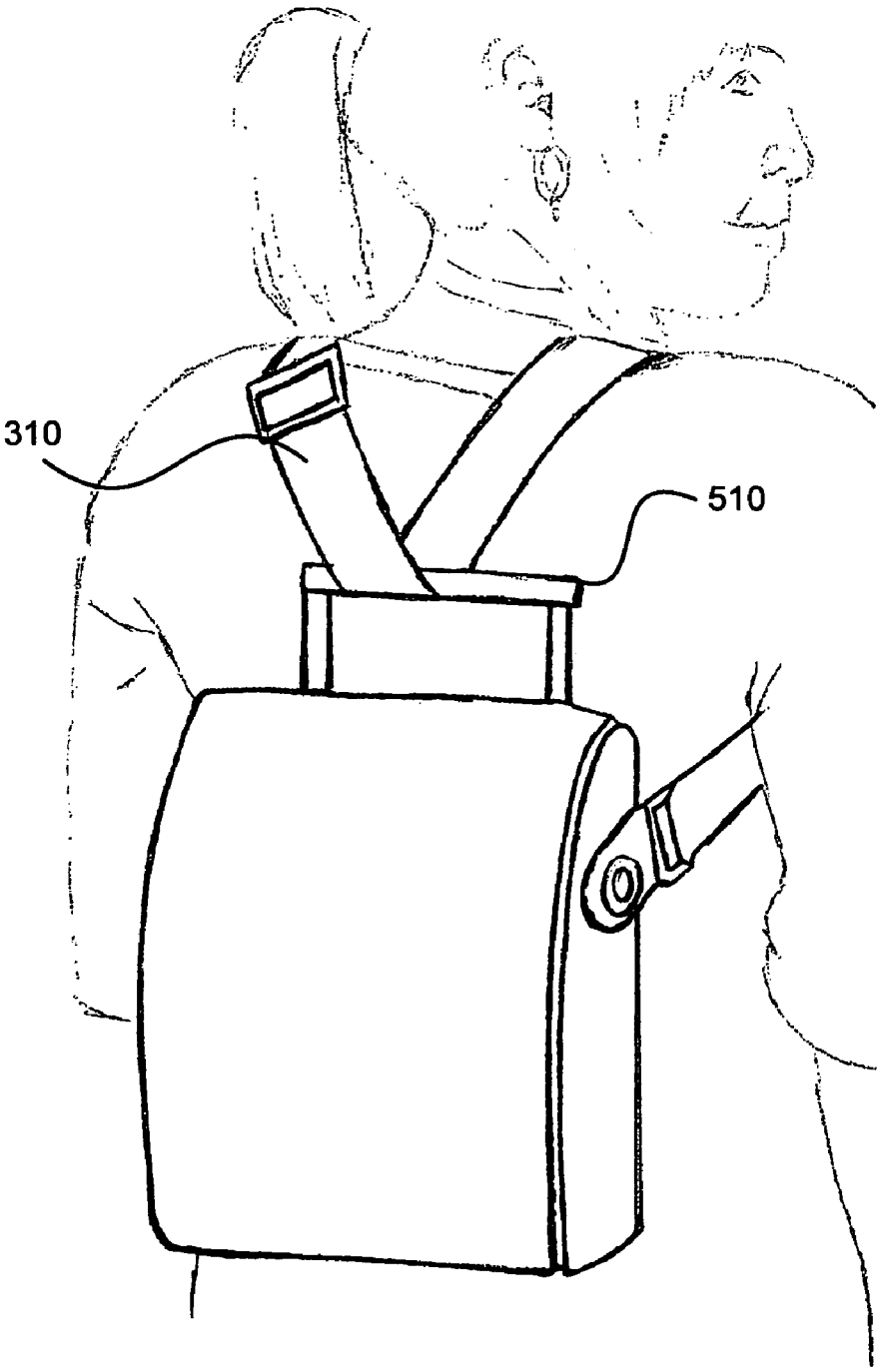
FIG. 5 illustrates how a handbag can be carried using a retractable handle and shoulder strap, in accordance with the exemplary embodiment.

A handbag, in accordance with exemplary embodiment, is equipped with a detachable shoulder strap 310 shown in FIG. 3. The shoulder strap 310 is attached to the side walls 100 by means of radial hinge-like buckles 320. A handbag can be carried over the shoulder as shown in FIG. 4 or it can be carried as a backpack as shown in FIG. 5. The latter method requires a use of a extendable handle 510 also depicted in FIG. 7. The top flap 110 of the exemplary embodiment conveniently covers the entire bag except for the side walls 100 as can be seen from FIGS. 1-3. In the preferred embodiment the top flap 110 is detachable. It can be attached to the handbag's back wall 120 (FIG. 1) by a zipper, by Velcro™ pads, by a magnet, by a buckle, by riveted buttons, etc.

Figure 6:
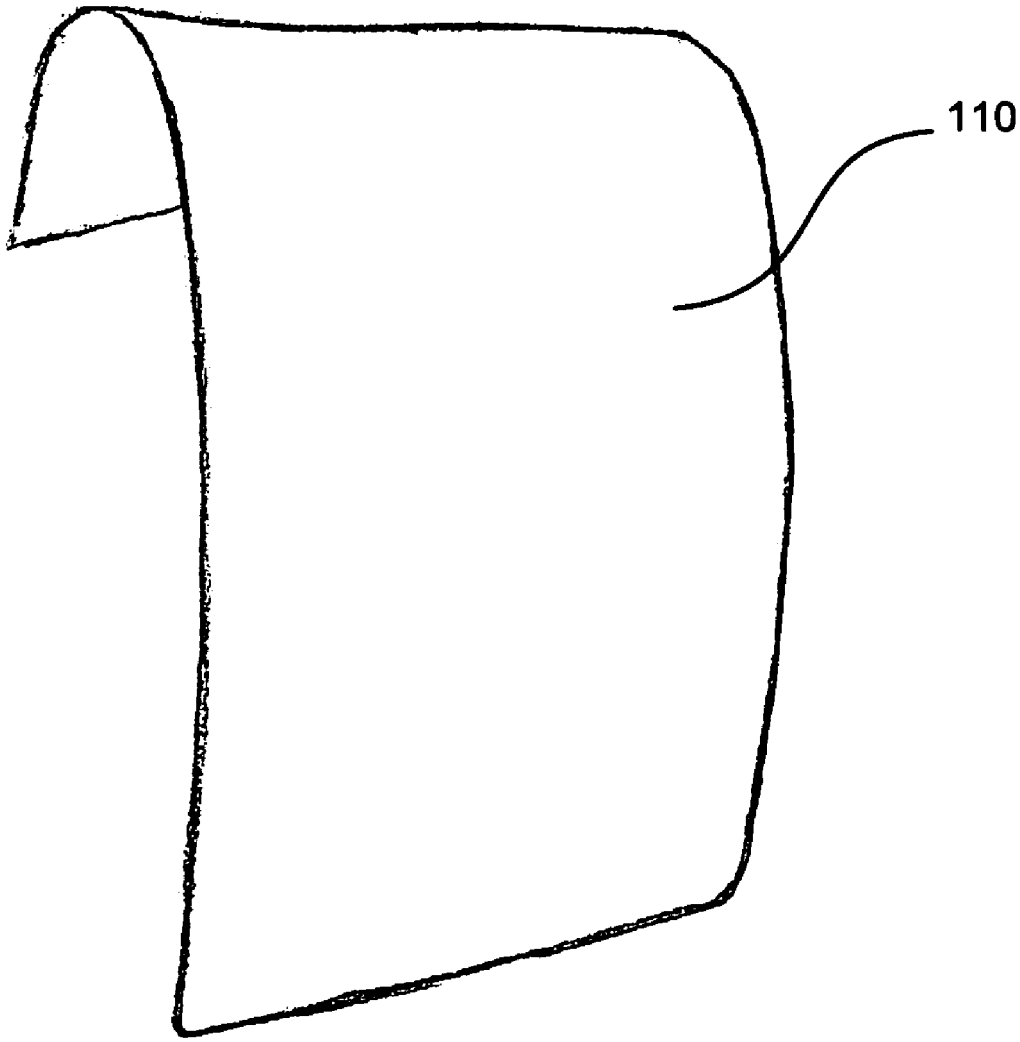
FIG. 6 shows detachable top flaps of a handbag, in accordance with the exemplary embodiment.

Therefore, by changing the detachable top flap 110 shown in FIG. 6, a user can essentially change color, style and overall appearance of the handbag. Alternatively, the handbag can have a number of pairs of side wall covers that match the corresponding top flaps. Thus, by replacing the top flap 110 and attaching a pair of matching side wall covers, a user can give his or her handbag an entirely new look. This appearance changing feature should be particularly appreciated by fashionable users, who like to match style and color of their handbags to their outfits. The side wall covers can be attached by zippers, by Velcro™ pads, by magnets, by special buckles, by riveted buttons, etc.

Figure 7:
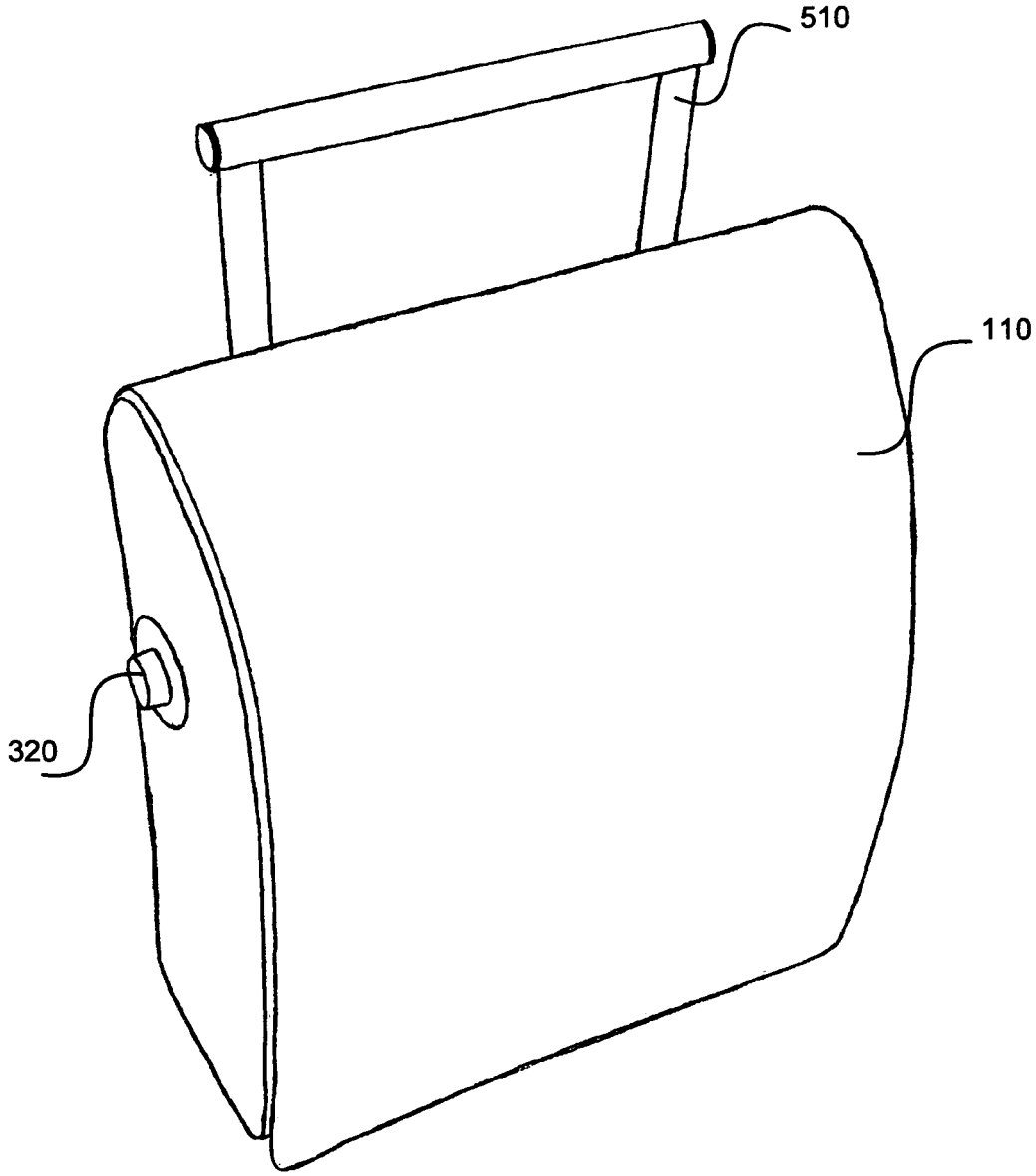
FIG. 7 shows a front view of a handbag with a handle retracted, in accordance with the exemplary embodiment.
Figure 8:
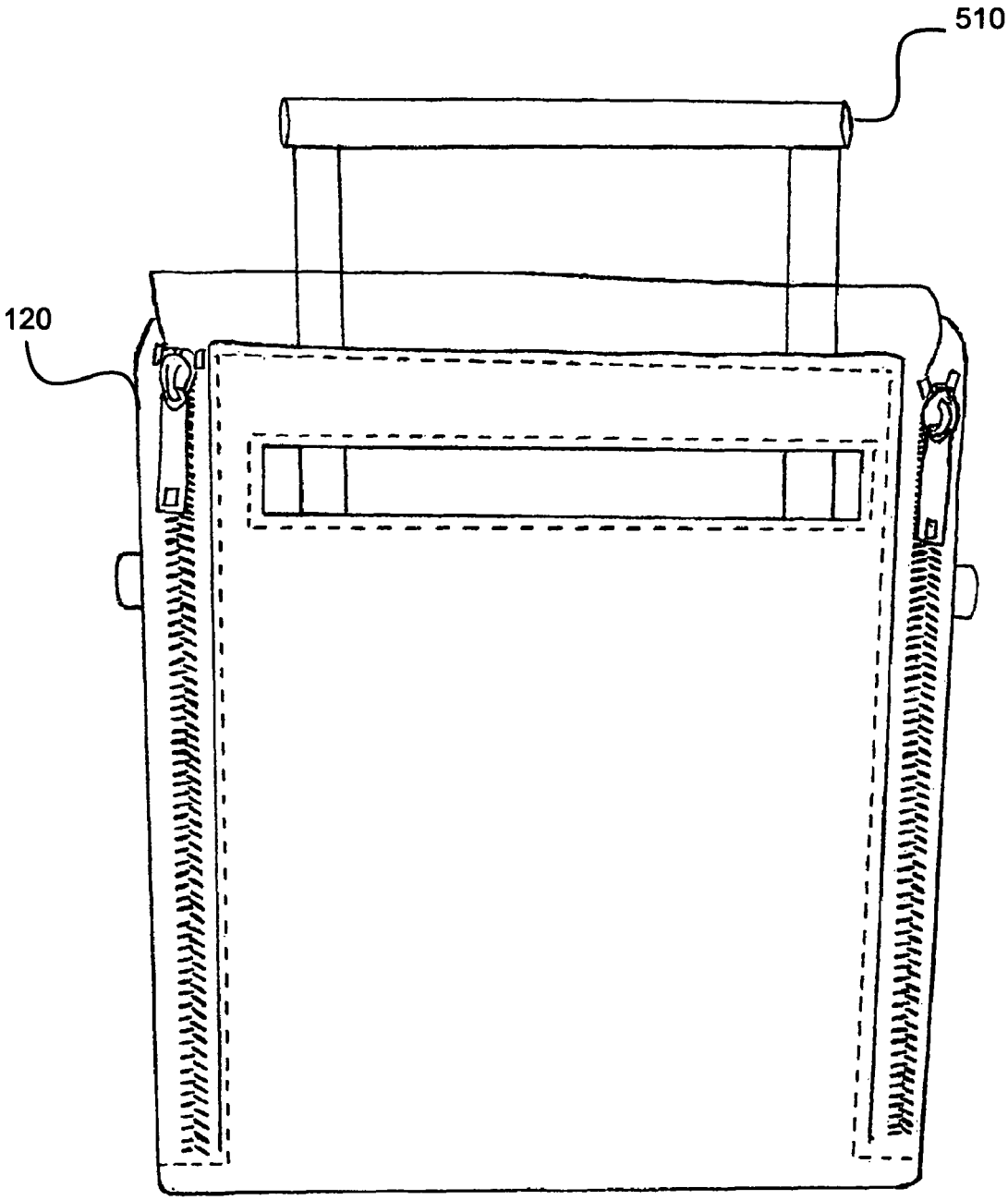
FIG. 8 shows back view of a handbag with a handle retracted, in accordance with the exemplary embodiment.
Figure 9:
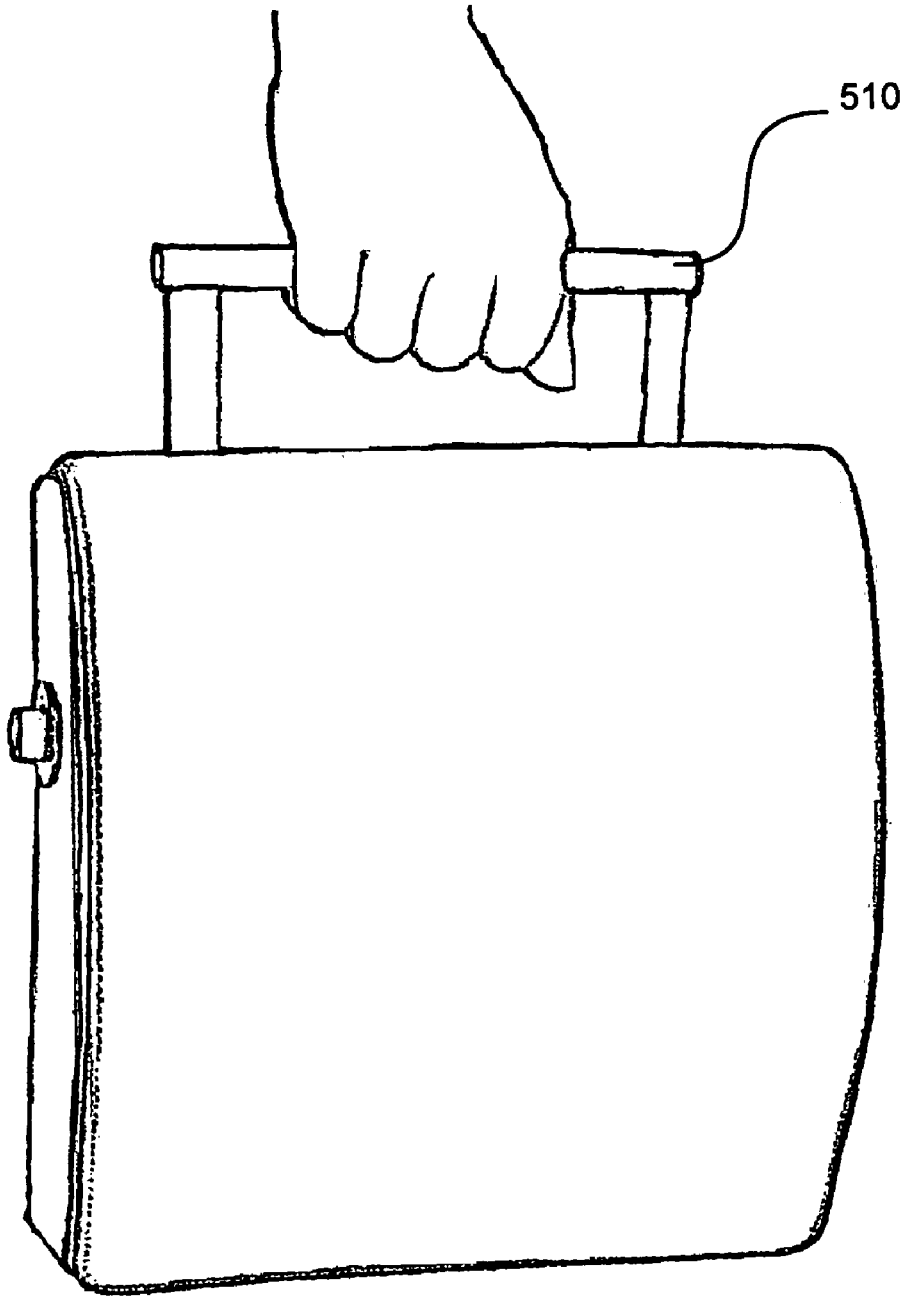
FIG. 9 illustrates how a handbag, in accordance with the exemplary embodiment, can be carried using retractable handle.

Yet another convenience feature of the preferred embodiment is a extendable handle 510 that is completely hidden and can be easily extended when needed as shown in FIG. 7. A back view of a handbag with an extended handle is shown in FIG. 8. The handle 510 slides up and down within channels 1410 formed inside a divider flap 1120 shown in FIG. 14. This feature provides a user with another convenient way of carrying the handbag as if it were a briefcase, as illustrated in FIG. 9. The shoulder strap 310 (FIG. 3) can be removed and stored inside the handbag when the extendable handle is used.

This convenience feature basically provides users with some flexibility in terms of multiple ways of using the same handbag. For example, using a handbag with the shoulder strap is convenient when traveling and using it as a backpack can be convenient when walking around and/or site seeing. However, in the office environment, using the same handbag as a small brief case can be very trendy and more appropriate.

Figure 10:
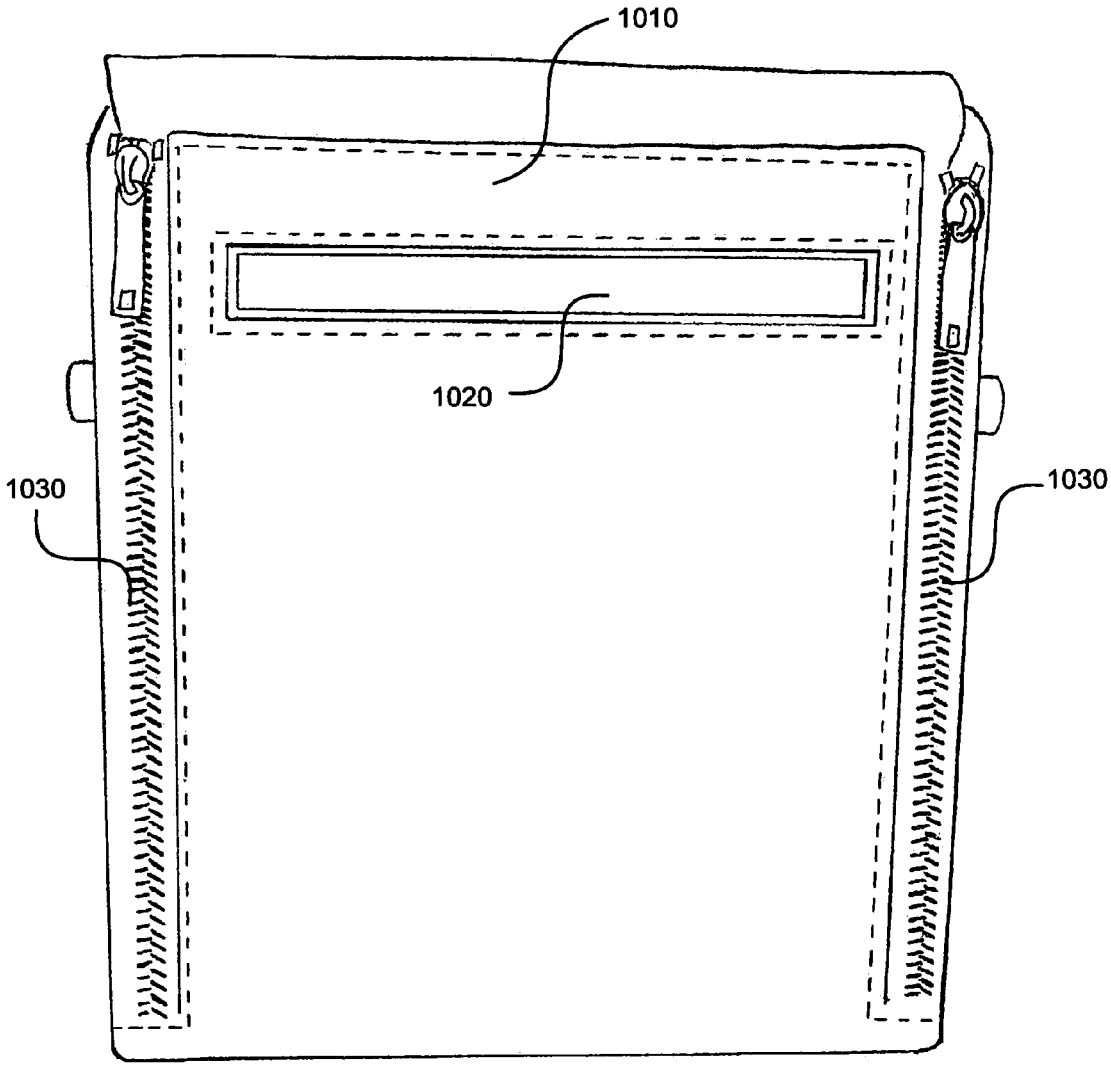
FIG. 10 shows a back view of a handbag with a retractable handle being hidden, in accordance with the exemplary embodiment.
Figure 11:
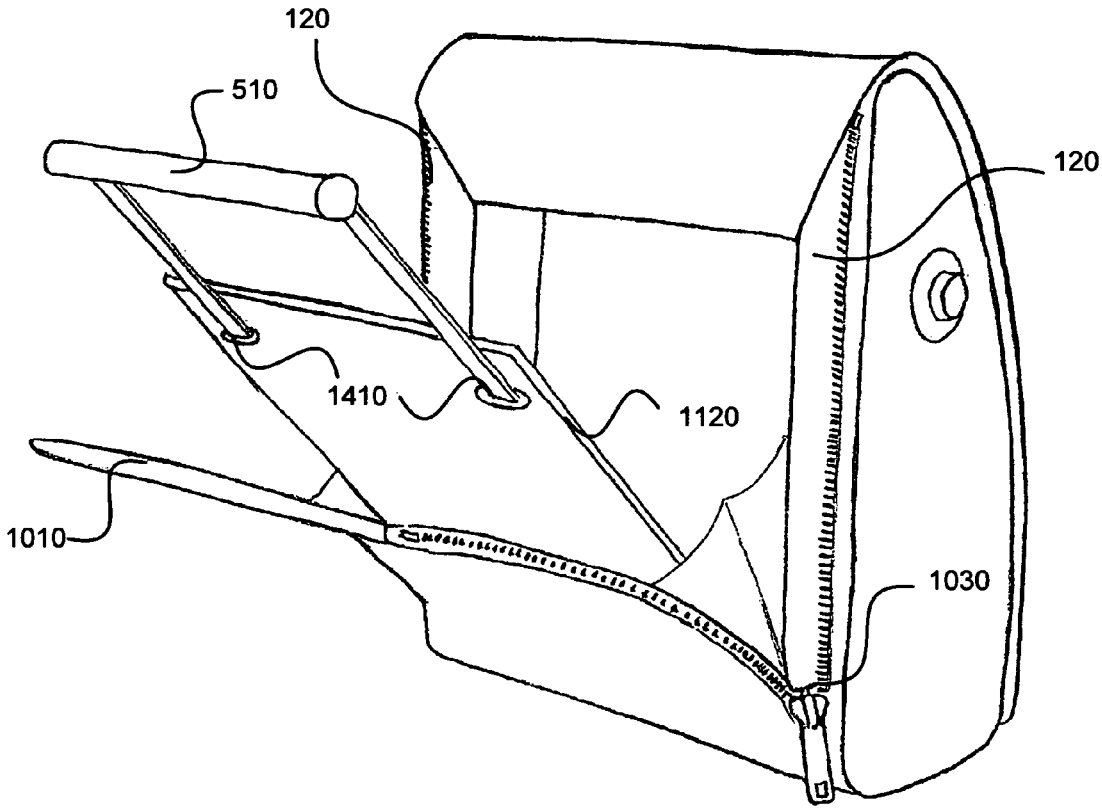
FIG. 11 shows a special compartment for the retractable handle, in accordance with the exemplary embodiment.

Note that the handle 510 can be completely hidden and covered by the back flap 1010, as illustrated in FIG. 10. The extendable handle 510 slides inside the channels 1410 of a divider flap 1120 shown in FIG. 11. Then, when the side zippers 1030 (or other means) of the back flap 1010 are closed, the handle 510 is completely hidden inside the divider flap 1120 but can be easily accessed and retrieved though a special window 1020 in the back flap 1010 as shown in FIG. 10 and in FIG. 12. Please note that the back flap can be closed by using zippers, buckles, magnets, Velcro™ pads, special riveted buttons or any other means.

Figure 12:
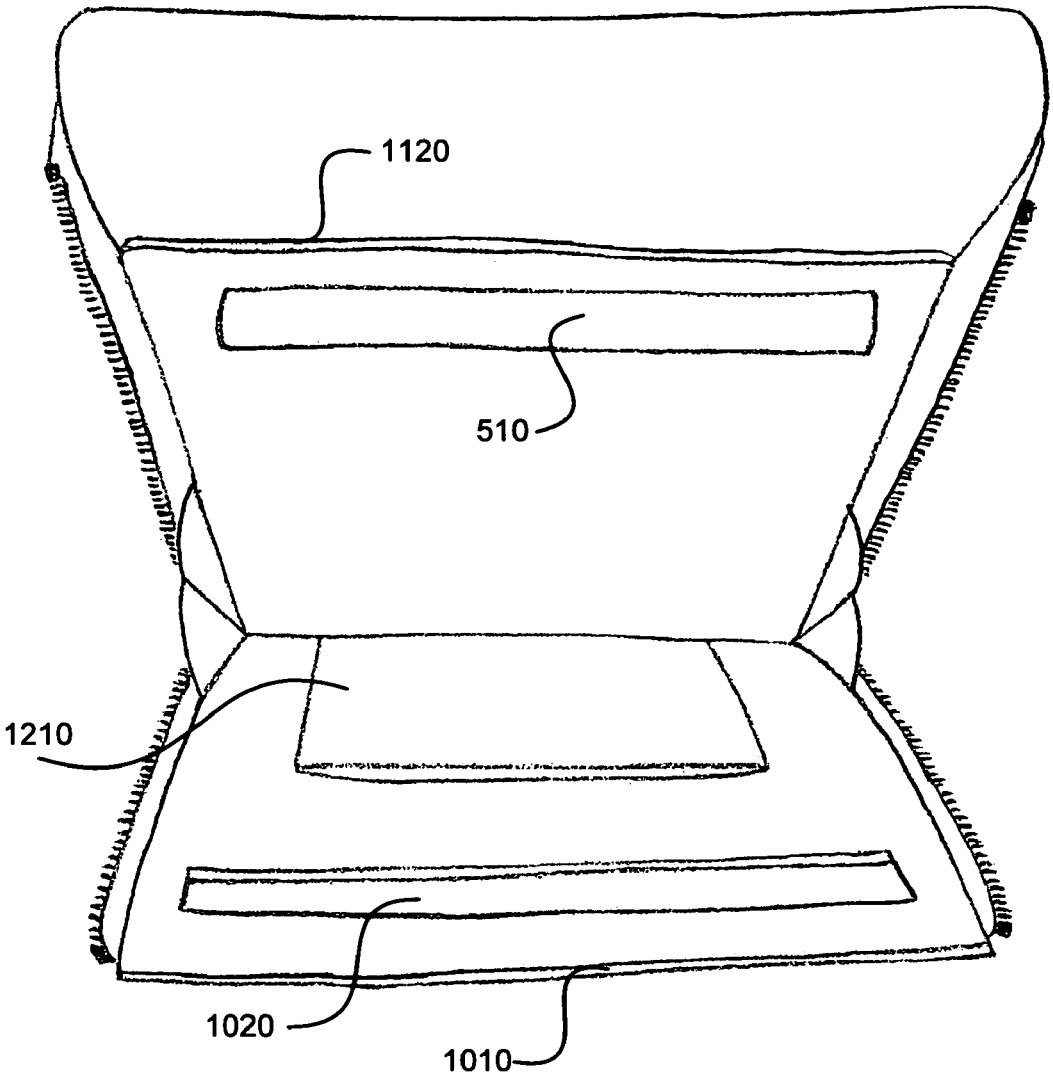
FIG. 12 shows a document compartment of a handbag, in accordance with the exemplary embodiment.
Figure 13:
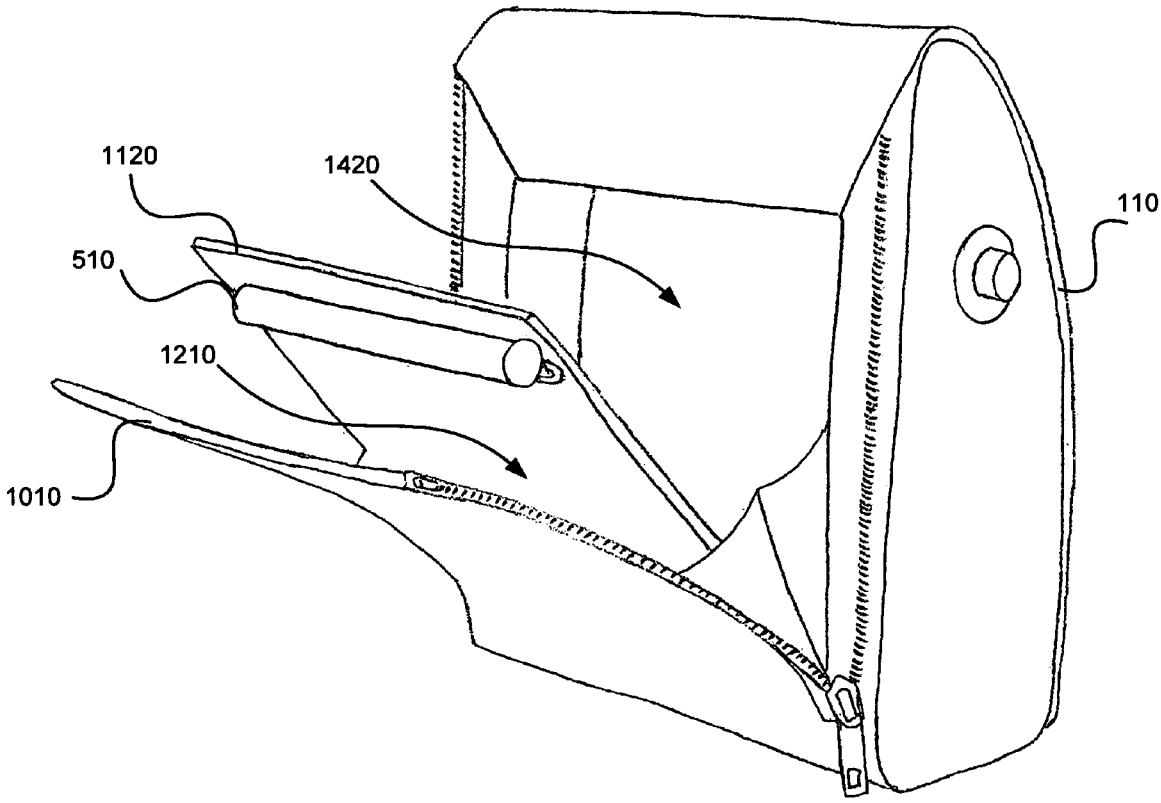
FIG. 13 shows a secret compartment of a handbag, in accordance with the exemplary embodiment.

The handbag of the preferred embodiment is also equipped with some hidden compartments that cannot be accessed through the opening at the top of the handbag. For example, a secret document compartment 1210 equipped with several pockets is located between the back flap 1010 and the a divider flap 1120 as shown in FIGS. 12 and 13. Note that a quick and convenient access to documents stored in this compartment is provided without a user having to open the handbag and unfold the top flap 110. All a user has to do is to unzip (or undo, in case of other means of attaching the back flap) or even partly unzip the back flap 1010 and a needed document can be retrieved from the secret document compartment 1210 without searching through all other stuff inside the handbag.

Figure 14:
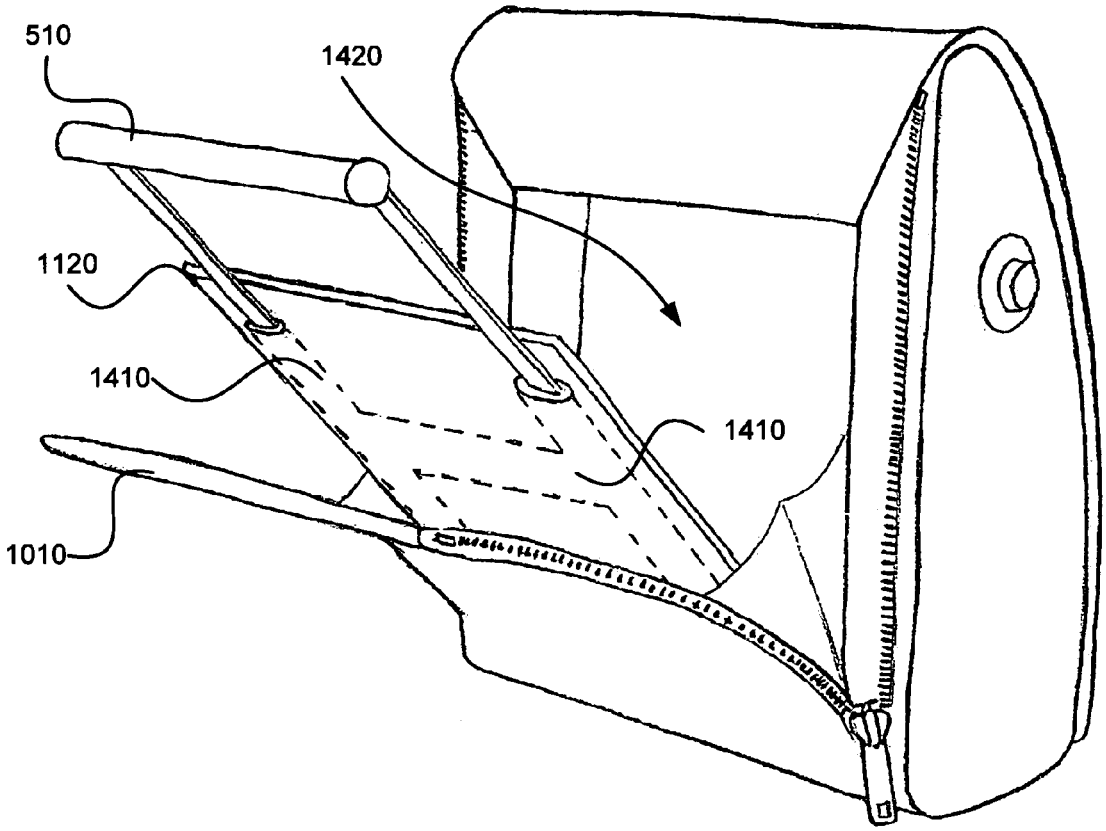
FIG. 14 shows an internal secret compartment of a handbag, in accordance with the exemplary embodiment.

Yet another secret storage compartment 1420 is located behind the divider flap 1120 as shown in FIG. 14. This can be considered a true secret compartment, as it is almost impossible to find by a thief or pickpocket even if he quickly unzips the back flap 1010 of the handbag. All the thief is going to see is the secret document compartment 1210 as shown in FIG. 13. The thief would have no way of quickly figuring out that there is another true secret compartment 1420 located behind the divider flap 1120. It is also worth mentioning that a thief gaining access to the handbag through the main opening (i.e., by unfolding the top flap 110) would not get access to valuables stored in the secret compartment 1420.

Note that the secret compartment 1420 shown in FIGS. 13 and 14 is made with the slick stretchable spandex-like material lining its back wall that is formed by an internal back wall of the handbag. This material allows objects of any shape to be stored in the compartments. The slick stretchable spandex-like fabric also provides for fast retrieval of things and documents out of the secret compartment 1420. The secret compartment 1420 is essentially blocked by the extendable handle 510 that, when placed in a regular (not-extended) position, locks the entry to the secret compartment 1420.

Figure 15:
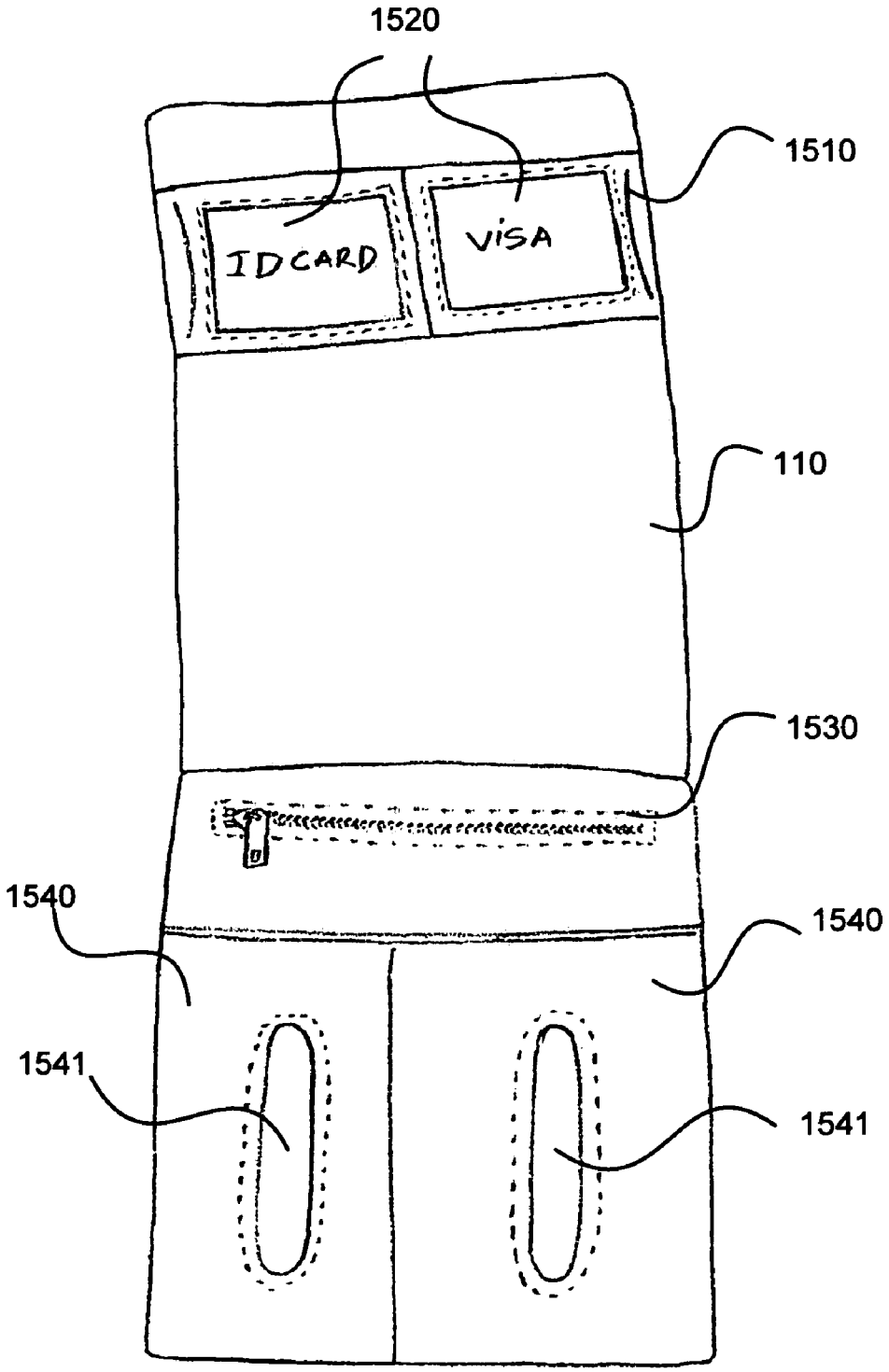
FIG. 15 shows a secure ID features implemented in a top flap of a handbag, in accordance with the exemplary embodiment.

Another convenient and secure feature of the preferred embodiment is a secure ID compartment feature 1510 implemented in the top flap 110 of a handbag shown in FIG. 15. While there are only two card windows shown in FIG. 15, any number of special card windows can be implemented on the inside of the top flap 110. This convenience feature effectively provides for secure hidden storage of person's ID cards and other important cards such as health insurance, membership or credit cards, magnetic key cards for bus, subway, etc. The cards can be easily displayed upon request through clear plastic windows 1520 without being taken out of a secure ID compartment 1510 or in the case of the magnetic key cards, they can be quickly identified by simply flashing the top flap into the proximity of the magnetic reader device without ever taking out the magnetic key card. This effectively provides a "flash and go" experience for users. This, obviously, provides a significant convenience to the users, who do not need to search for a wallet or the card itself among the variety of items that can be typically present in the handbag.

Figure 16:
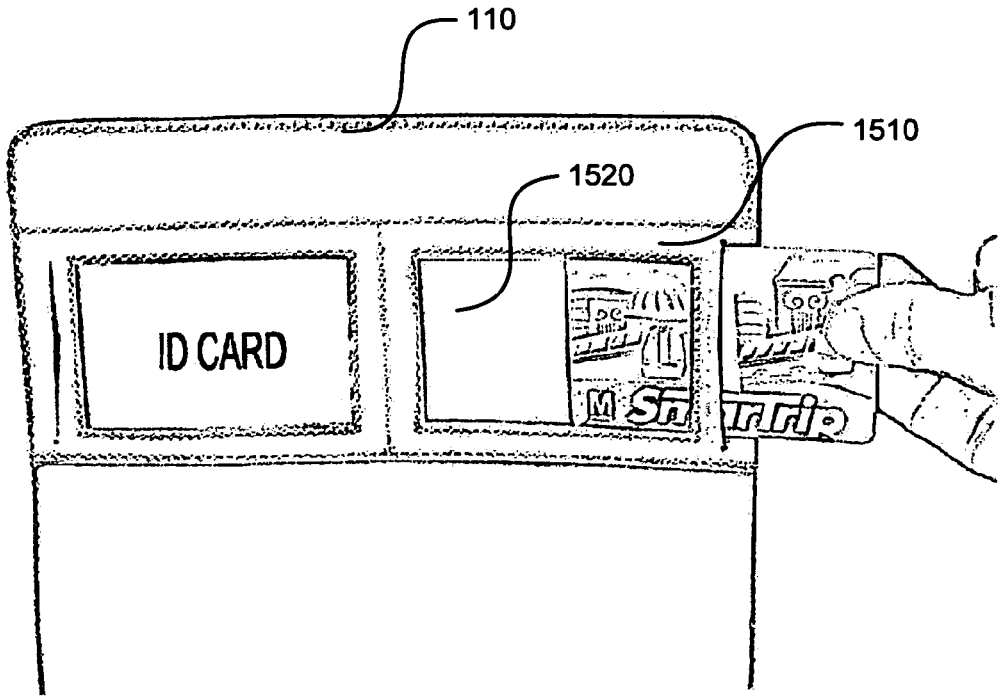
FIG. 16 illustrates how an ID can be extracted from the secure ID feature, in accordance with the exemplary embodiment.

However, if taking a card out of the ID compartment 1510 is necessary, for example, in case of a credit card or a driver license, it can be easily done as shown in FIG. 16. Those skilled in the art would appreciate that this feature advantageously decreases a risk of an ID card being misplaced, lost or stolen as it can happen each time the ID card is taken out of the wallet. FIG. 16 also displays a loose change pocket equipped with a zipper 1530 and cell phone and Ipod compartments 1540 located on the front of the bag under the to flap 110. The compartments 1540 are equipped with finger windows 1541. A user can easily insert a finger into the window 1541 and retrieve a cell phone or an Ipod by simply sliding the object out of the compartment 1540. A back wall of the compartments 1540 is lined by a stretchable spandex-like material for keeping the objects from sliding out of the compartments 1540 by themselves.

Furthermore, taking the wallet out of a handbag every time the ID card is requested also presents some risks of it being lost or stolen. A person can be busy looking after his or her luggage, attending to children, handling event or airline tickets, talking on a cell phone and doing other things while quickly showing his or her ID encapsulated into the compartment inside the top flap of a handbag without searching through a handbag for the wallet.

Having thus described a preferred embodiment, it should be apparent to those skilled in the art that certain advantages of the described carrying container have been achieved. In particular those skilled in the art would appreciate that a carrying container described herein provides a variety of highly needed convenience features to a user. It should also be appreciated that various modifications, adaptations, and alternative embodiments thereof may be made within the scope and spirit of the present invention. The invention is further defined by the following claims.

What is claimed is:

1. An ergonomically shaped handbag with convenience features, the handbag comprising:

half-elliptic side walls;

a detachable top flap having a plurality of secure card compartments;

a back flap being an integral part of the handbag and attachable to the side walls;

a plurality of internal compartments, wherein the internal compartments are inaccessible from a front and from a top of the handbag;

a hidden extendable handle located inside a divider flap; and a detachable shoulder strap, wherein:

the top flap closes under its own weight and covers a main access opening at a top of the handbag and the entire front of the handbag, and the back flap comprises a window for accessing the extendable handle and wherein means for fastening the back flap are selected from:

zippers;

magnets;

pads of hook and loop material;

buckles; and riveted buttons.

2. The handbag of claim 1, wherein the divider flap is located behind the back flap.

3. The divider flap of claim 2, comprising channels for accepting the handle, the channels are made in such a way that when the handle slides all the way down into the channels it becomes completely hidden behind the back flap.

4. The handbag of claim 1, wherein the top flap is equipped with any of:

a magnet;

a pad of hook and loop material;

a lock;

a buckle;

a zipper; and a riveted button.

5. The handbag of claim 1, wherein a secret compartment is located between the divider flap and an internal back wall of the handbag.

6. The secret compartment of claim 5, wherein the back wall forming the back side of the compartment is made of a stretchable fabric.

7. The handbag of claim 5, wherein the secret compartment is not accessible through the main access opening at the top of the handbag.

8. The handbag of claim 1, wherein the secure card compartments comprise clear plastic windows.

9. The handbag of claim 1, wherein a document compartment is located on the back flap.

10. The handbag of claim 1, wherein a secret document compartment is located between the back flap and the divider flap.

11. The handbag of claim 1, wherein the top flap is replaced by a top flap of a different color.

12. The handbag of claim 1, wherein the top flap is replaced by a top flap of a different design.

13. The handbag of claim 1, further comprising side wall covers.

14. The handbag of claim 13, wherein the side wall covers match a color of the top flap.

15. The handbag of claim 13, wherein the side wall covers match the design of the top flap.

16. An ergonomically shaped handbag with convenience features for carrying the handbag as a backpack, the handbag comprising:

half-elliptic side walls;

a detachable top flap having a plurality of secure card compartments, the top flap closes under its own weight and covers a main access opening at a top of the handbag;

a back flap attachable to the side walls;

a plurality of internal compartments, wherein secret compartments are inaccessible from a front and from a top of the handbag;

a hidden extendable handle located inside an inner divider flap positioned inside the handbag;

a detachable shoulder strap, wherein the shoulder strap is attached to the sidewalls using radial hinges, wherein:

the shoulder strap is attached to one of the sidewalls; and the shoulder strap is looped around the extendable handle and attached to the other sidewall of the handbag.

* * * * *